United States Patent [19]

Phillips

[11] 4,379,649

[45] Apr. 12, 1983

[54] CONNECTOR SYSTEM FOR GEODESIC DOME STRUTS

[76] Inventor: Martha E. Phillips, 3906 Ridgecroft Rd., Baltimore, Md. 21206

[21] Appl. No.: 307,377

[22] Filed: Oct. 1, 1981

[51] Int. Cl.[3] ..... E04B 1/58

[52] U.S. Cl. ..... 403/172; 52/81

[58] Field of Search ..... 403/171, 172, 175, 176, 403/170; 52/81

[56] References Cited

U.S. PATENT DOCUMENTS

| | | | |
|---|---|---|---|
| 3,486,278 | 12/1969 | Woods | 52/81 |
| 3,990,195 | 11/1976 | Gunther | 52/81 |
| 4,122,646 | 10/1978 | Sapp | 403/171 X |

FOREIGN PATENT DOCUMENTS

| | | | |
|---|---|---|---|
| 87073 | 3/1956 | Norway | 403/170 |

*Primary Examiner*—Andrew V. Kundrat

*Attorney, Agent, or Firm*—John F. McClellan, Sr.

[57] ABSTRACT

A plural-single-sweptback geodesic dome connector system for joining struts to arms of the connector provides a uniform circular hub periphery permitting assembly-connection of the arms at any selected peripheral angles to the hub; hub diameter may advantageously be 1.75 times strut width to provide laterally abutting bracing of struts for six-arm uniform-arm spacing connectors.

1 Claim, 2 Drawing Figures

CONNECTOR SYSTEM FOR GEODESIC DOME STRUTS

FIELD OF THE INVENTION

This invention relates generally to building components and specifically to connectors for geodesic domes.

BACKGROUND OF THE INVENTION

The prior art includes U.S. Pat. No. 3,990,195 issued to R. R. Gunther on November 9, 1976 for "HUB FOR GEODESIC DOME FRAMEWORK CONSTRUCTION". That patent discloses a spider-like connector construction of plates forming at least three single arms radially deployed from a hub comprising a central metal rod. Each plate has a slot and a hole or else two holes passing through it to receive fasteners for holding an end of a respective strut which is slotted to slip over the plate and which has holes matching the opening in the plate.

The aforesaid U.S. Pat. No. 3,990,195 stresses the need for at least two openings in each plate and apart from the fasteners provides no means of limiting travel of the struts under load radially toward the center to prevent further splitting of the struts by the plates if the fasteners are loose or in oversize holes. Further, there appears to be little or no provision for minimizing bending loads on the plates in circumferential direction. Still further, the weld at the center which holds the ⅜ inch diameter rod to the plates appears to be necessarily made in cramped quarters where cracks would be difficult to see and where all parts of the central junction might have to be heated as many times as there are arms, opening the way for expansion and contraction cracking. If cast instead of welded, the central junction presents difficulties of inspection and the same small-scale difficulties in welded or in cast construction tend to produce stress concentration in any case.

Further, the small solid central junction makes coverage of the central portion difficult to inspect from inside the dome.

U.S. Pat. No. 4,122,646 issued to D. H. Sapp on 10-3-1-78 discloses an elongate finned tube derrick connector having a circular tube with single fins or arms radiating from it but with ends perpendicular to long axis.

OBJECTS OF THE INVENTION

Objects of the present invention therefore include providing a geodesic dome hub system of the split-strut type, with plural single sweptback arms, which will keep stress concentration low, which will make fabrication easier and the units less prone to cracking, and importantly, which can reduce the need for fastening to one hole per strut end under certain circumstances.

Further objects are to provide a system as described in which in many cases the welds can be inspected even though the struts extend fully to the center where they tend to support themselves and the hub and provide a more rigid structure. An important object is to provide for almost an unlimited variety of angular spacings between arms.

BRIEF SUMMARY OF THE INVENTION

In brief summary given as cursive description only and not as limitation the invention includes a hub system of the split-strut type which comprises a cylindrical-tube center from which a plurality of arms radiate, the arms being plate-like and at requisite swept-back angles to the axis of the cylindrical-tube center, and the cylindrical-tube center can be proportionally substantially large in diameter so that "two-by-four" struts can abut it and secure support and load spreading at the center. Each plate-like member is in a plane generally parallel with the axis of the cylindrical tube center.

BRIEF DESCRIPTION OF THE DRAWINGS

The above and other objects and advantages of this invention will become more readily apparent on examination of the drawings, in which like reference numerals refer to like parts.

DETAILED DESCRIPTION OF THE DRAWINGS

Figure 1:
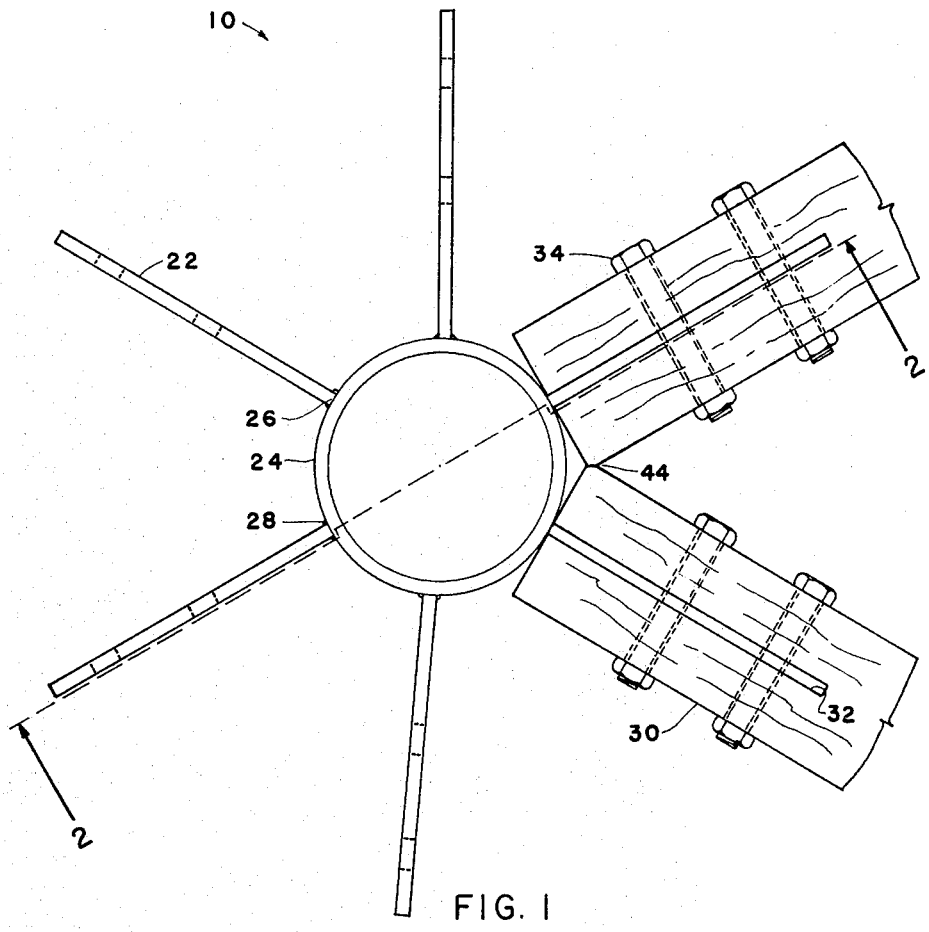
FIG. 1 is a plan view of a typical connector made according to this invention.
Figure 2:
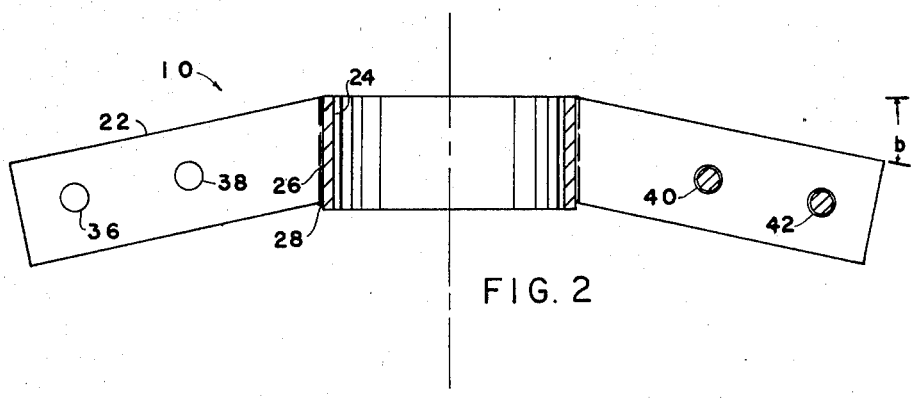
FIG. 2 is a side elevational view in partial section, taken at 2–2, FIG. 1.

FIGS. 1 and 2 show the connector 10 partially assembled with geodesic dome struts. It will be appreciated that the connector showing is for illustrative purposes only in that it assembles fully with one arm per strut and can have more or fewer arms (at least three) and differing arm angles in both plan and elevational views to suit particular needs. The differing arm peripheral-spacing angles can be produced by welding type assembly without concern for corners, the round hub being of uniform periphery.

The arms 22 may typically be steel plates of 5 inch length by 2 inches width by 1/16 inch thickness (12.5 cm by 5 cm by 0.15 cm) radiating from a central hub 24. Angular spacing a between the arms may be regular, or may be irregular, if required.

Pre-angled ends 26 of the plate may be connected at these pre-defined angles to the hub by welds 28 or may be integrally cast, and may among them have any desired sweep-back angle or angles b or deviation from a radial plane perpendicular to the hub axis. The struts preferably have similarly angled ends.

Each hub is a right cylinder or uniform cylindrical tube with ends perpendicular to axis, which may be typically of steel, 3½ inches O.D. by 2 inches long with a 1/16 inch or greater wall thickness (8.5 cm by 5 cm by 0.15 cm).

Struts 30, which may be elongate uniform-width wooden members of two inches width in plan view, and may join the connectors to each other according to any of many well known construction patterns to form geodesic domes. For connection, each strut 30 accepts a connector arm in an attachment aperture or end-slot 32, and one or more bolts 34 pass through matched holes 36, 38, 40, 42 respectively in the struts and arms and provided for the purpose. For the struts to abut slightly laterally on each other as shown and brace each other as at 44, and yet have abutting termination on the hub as shown, the hub should be greater in diameter than the width of the uniform-width struts, as noted. The ratio may advantageously be 1.76 to 1 of hub diameter to strut width in plan view, for six-arm uniform spacing. Each end slot may be sawed along the long centerline of a strut and may be just long enough to receive the respective arm with the strut 30 abutted against the hub 24. It is evident that only one bolt and hole in each arm and preferably in position of the radially outer hole, can hold the strut in assembly because of the stability imparted by the abutting relation of strut-end and hub, and that circumferentially adjacent struts fitted against each other can brace the structure in that direction.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a connector system for geodesic dome struts, said connector being of the type having a hub with members radiating therefrom in the form of a plurality of peripherally-spaced arms having connection in swept-back-angle relation to a plane through the hub perpendicular to the axis of the hub, said struts having structure forming attachment-apertures in respective ends thereof, the improvement comprising: means permitting connection of a said arm at any location around the hub including each hub being a right-cylinder in configuration with each arm swept-back angle being defined by an angle of said arm at the point of said connection to the hub, each arm being a plate-like member in a plane generally parallel with the axis of said right cylinder, the diameter of each hub being sufficiently greater across than the width of a said strut affixable thereto to provide for abutting termination of said strut on the hub, the ratio of hub-diameter to strut width being substantially one and three-quarters to one for a said connector with six arms uniformly spaced around the periphery of the hub, and said connection being welded connection.

* * * * *